US006062823A

United States Patent [19]

Kawaguchi et al.

[11] Patent Number: 6,062,823

[45] Date of Patent: May 16, 2000

[54] CONTROL VALVE IN VARIABLE DISPLACEMENT COMPRESSOR

[75] Inventors: Masahiro Kawaguchi; Ken Suitou; Masanori Sonobe; Tetsuhiko Fukanuma, all of Kariya, Japan

[73] Assignee: Kabushikki Kaisha Toyoda Jidoshokki Seisakusho, Aichi-ken, Japan

[21] Appl. No.: 08/990,639

[22] Filed: Dec. 15, 1997

[30] Foreign Application Priority Data

Dec. 16, 1996 [JP] Japan ..... 8-335739

[51] Int. Cl.[7] ..... F04B 1/26; F16K 31/02

[52] U.S. Cl. ..... 417/222.2; 251/129.02; 251/129.07; 251/129.15

[58] Field of Search ..... 417/222.1, 222.2, 417/213; 251/129.02, 129.07, 129.15

[56] References Cited

U.S. PATENT DOCUMENTS

| | | | |
|---|---|---|---|
| 4,846,630 | 7/1989 | Fujii et al. | 417/222.2 |
| 4,860,549 | 8/1989 | Murayama | 417/222.2 |
| 5,145,326 | 9/1992 | Kimura et al. . | |
| 5,282,329 | 2/1994 | Teranishi | 417/222.2 |
| 5,584,670 | 12/1996 | Kawaguchi et al. | 417/222.2 |
| 5,702,235 | 12/1997 | Hirota et al. | 417/222.2 |
| 5,807,076 | 9/1998 | Kawaguchi et al. | 417/222.2 |

FOREIGN PATENT DOCUMENTS

| | | |
|---|---|---|
| 0 366 348 A1 | 5/1990 | European Pat. Off. . |
| 0 498 552 A1 | 8/1992 | European Pat. Off. . |
| 0 628 722 A1 | 12/1994 | European Pat. Off. . |
| 0628722 | 12/1994 | European Pat. Off. . |

*Primary Examiner*—Timothy S. Thorpe
*Assistant Examiner*—Michael K. Gray
*Attorney, Agent, or Firm*—Morgan & Finnegan, L.L.P.

[57] ABSTRACT

A variable displacement compressor includes a gas passage for connecting a discharge chamber with a crank chamber. The control valve is located in the gas passage to control the pressure in the crank chamber. The control valve has a valve hole and a valve chamber located in the gas passage. A valve body is located in the valve chamber to adjust the opening size of the valve hole. A solenoid has a plunger and a plunger chamber for accommodating the plunger. A rod is located between the plunger and the valve body to transmit the movement of the plunger to the valve body. When the solenoid is de-excited, the bottom end face of the plunger abuts against the inner bottom wall of the plunger chamber. A plurality of grooves are provided on the bottom end face of the plunger and extend radially. The grooves define recessed passages between the bottom end face of the plunger and the inner bottom wall of the plunger chamber to prevent the bottom end face from adhering to the inner bottom wall. This prevents the plunger from sticking, and thus improves the response of the control valve.

22 Claims, 7 Drawing Sheets

CONTROL VALVE IN VARIABLE DISPLACEMENT COMPRESSOR

BACKGROUND OF THE INVENTION

The present invention relates to a displacement control valve incorporated in variable displacement compressors that are used in vehicle air conditioners.

A typical variable displacement compressor has a supply passage for connecting a discharge chamber with a crank chamber and a displacement control valve located in the supply passage. The displacement control valve controls opening amount of the supply passage for adjusting the amount of highly pressurized refrigerant gas that is supplied to the crank chamber from the discharge chamber. The pressure in the crank chamber is changed, accordingly. This alters the difference between the pressure in the crank chamber and the pressure in cylinder bores. Changes in the pressure difference adjust the inclination of a swash plate of the compressor and ultimately change the displacement of the compressor.

A typical displacement control valve has a housing and a valve chamber defined therein. The valve chamber is connected to a supply passage of the compressor by a valve hole. The valve chamber and the valve hole constitute a part of the supply passage. A valve body is accommodated in the valve chamber for opening and closing the valve hole. A solenoid is attached to the housing. The solenoid includes a fixed steel core, a plunger and a coil. The plunger moves closer to and away from the fixed core. The plunger is operably coupled to the valve body by a rod. Feeding current to the coil of the solenoid generates magnetic attractive force between the fixed core and the plunger. The magnitude of the generated force corresponds to the magnitude of the fed current. Therefore, the opening area between the valve hole and the valve body is controlled by changing the magnitude of current fed to the coil. Accordingly, the amount of refrigerant gas passing through the supply passage is changed.

The rod, which couples the valve body with the plunger, extends through and is supported by a guide hole. The plunger is movably housed in a plunger chamber defined in the solenoid. Therefore, refrigerant gas in the valve chamber may leak to the plunger chamber through minute clearance between the rod and the guide hole. Misted lubricant oil contained in the refrigerant gas is also introduced to the plunger chamber.

Some compressors have a passage that communicates the plunger chamber with a crank chamber or with a discharge chamber for positively introducing refrigerant gas to the plunger chamber. This construction equalizes pressures acting on both sides of the valve body and thus stabilizes the valve body operation without being affected by refrigerant gas pressure. This construction also increases the amount of lubricant oil that is introduced to the plunger chamber.

The lubricant oil in the plunger chamber is spread on the wall of the chamber and on the surface of the plunger. The oil thus causes the plunger to adhere to the wall of the plunger chamber and hinders the movement of the valve body. Specifically, lubricant oil may cause the end of the plunger to adhere to the inner wall of the plunger chamber when the solenoid is not excited. If excited in this state, the solenoid does not quickly attract the plunger. In this manner, lubricant oil in the plunger chamber hinders rapid movement of the valve body.

Especially, in a displacement control valve that controls the opening between a valve body and a valve hole by changing the magnitude of a solenoid coil current, the movement of the plunger must follow the subtle changes of the coil current. If a plunger adheres to a surface due to lubricant oil, the plunger fails to accurately follow subtle changes in the coil current. The opening of the valve hole is thus not accurately controlled.

SUMMARY OF THE INVENTION

Accordingly, it is an objective of the present invention to provide a variable displacement compressor control valve in which a plunger for displacing a valve body is smoothly moved.

To achieve the above objective, the present invention provides a control valve in a variable displacement compressor that adjusts the discharge displacement in accordance with the inclination of a drive plate located in a crank chamber. The compressor includes a piston operably coupled to the drive plate. The piston is located in a cylinder bore. The piston compresses gas supplied to the cylinder bore from a suction chamber and discharges the compressed gas to a discharge chamber from the cylinder bore. The inclination of the drive plate is variable according to the difference between the pressure in the crank chamber and the pressure in the cylinder bore. The control valve adjusts the difference between the pressure in the crank chamber and the pressure in the cylinder bore. The compressor includes a gas passage for conducting gas. The control valve regulates the amount of gas flowing in the gas passage. A housing of the control valve has a valve hole located in the gas passage. A valve body cooperates with the valve hole. The valve body is movable to adjust the size of the valve hole. A solenoid actuates the valve body. The solenoid has a fixed core, a plunger cooperating with the core to move with respect to the core, and a plunger chamber for accommodating the plunger. The plunger chamber has a pair of opposed end walls. Electric current sent to the solenoid produces a magnetic attractive force between the core and the plunger in accordance with the value of the current. A rod is located between the plunger and the valve body to actuate the valve body in accordance with the magnetic attractive force. The plunger has a first end face contacting the rod and a second end face opposite to the first end face. The first and second end faces respectively face corresponding ones of the end walls. A recessed passage is defined between one of the end faces and a corresponding one of the end walls to prevent the one end face from adhering to one end wall.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A variable displacement compressor control valve according to a first embodiment of the present invention will now be described with reference to FIGS. 1 to 5.

Figure 3:
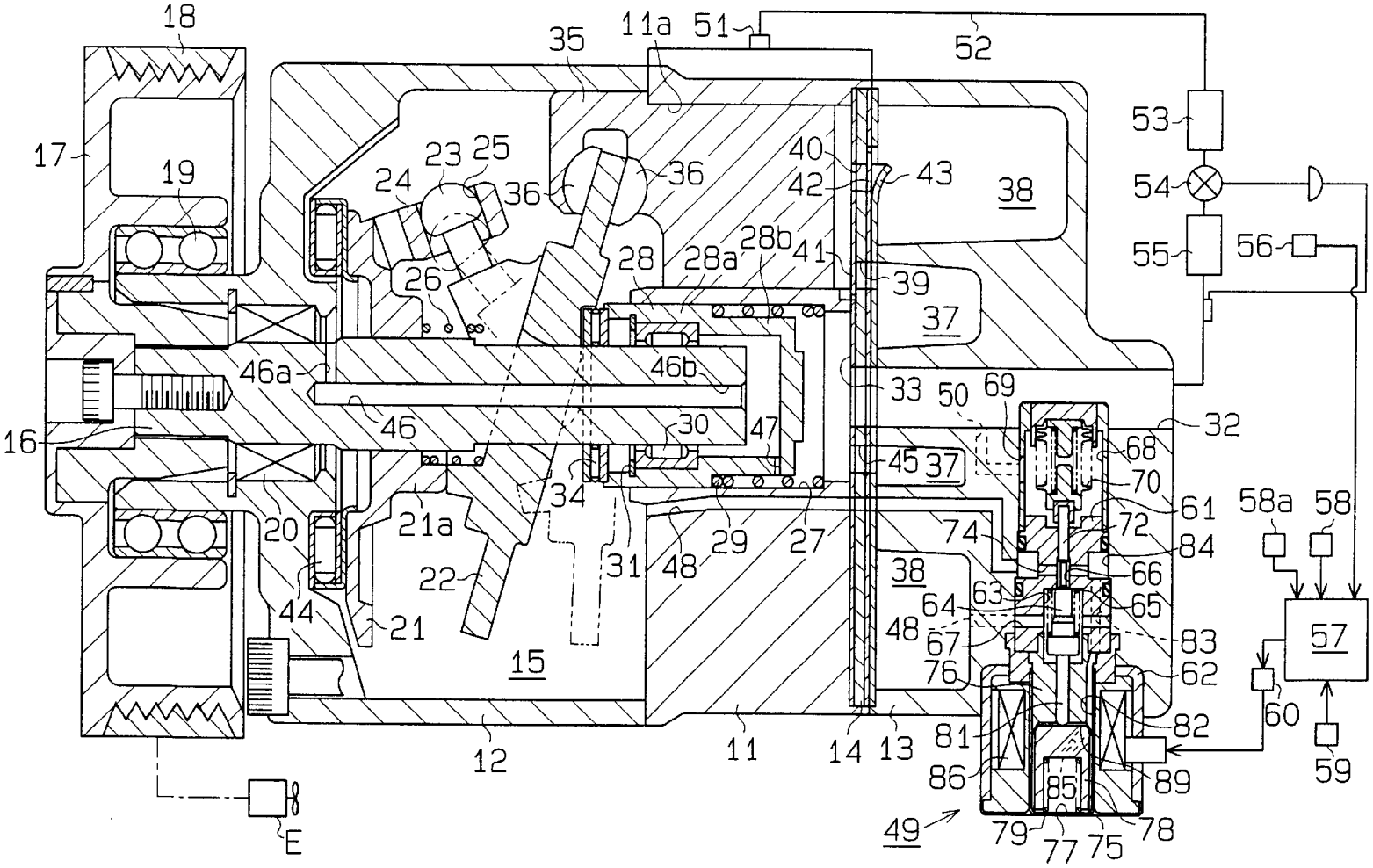
FIG. 3 is a cross-sectional view illustrating a variable displacement compressor having the control valve of FIG. 1.

Firstly, the structure of a variable displacement compressor will be described. As shown in FIG. 3, a front housing 12 is secured to the front end face of a cylinder block 11. A rear housing 13 is secured to the rear end face of the cylinder block 11 with a valve plate 14. A crank chamber 15 is defined by the inner walls of the front housing 12 and the front end face of the cylinder block 11.

A drive shaft 16 is rotatably supported in the front housing 12 and the cylinder block 11. The front end of the drive shaft 16 protrudes from the crank chamber 15 and is secured to a pulley 17. The pulley 17 is directly coupled to an external drive source (a vehicle engine E in this embodiment) by a belt 18. The compressor of this embodiment is a clutchless type variable displacement compressor having no clutch between the drive shaft 16 and the external drive source. The pulley 17 is supported by the front housing 12 with an angular bearing 19. The angular bearing 19 transfers thrust and radial loads that act on the pulley 17 to the housing 12.

A lip seal 20 is located between the drive shaft 16 and the front housing 12 for sealing the crank chamber 15. That is, the lip seal 20 prevents refrigerant gas in the crank chamber from leaking outside.

A drive plate, which is a disk-like swash plate 22 in this embodiment, is located in the crank chamber 15. The swash plate 22 is supported by the drive shaft 16 in the crank chamber 15 to be slidable along and tiltable with respect to the axis of the shaft 16. The swash plate 22 is provided with a pair of guiding pins 23, each having a guide ball at the distal end. The guiding pins 23 are fixed to the swash plate 23. A rotor 21 is fixed to the drive shaft 18 in the crank chamber 15. The rotor 21 rotates integrally with the drive shaft 16. The rotor 21 has a support arm 24 protruding toward the swash plate 22. A pair of guide holes 25 are formed in the support arm 24. Each guide pin 23 is slidably fitted into the corresponding guide hole 25. The cooperation of the arm 24 and the guide pins 23 permits the swash plate 22 to rotate together with the drive shaft 16. The cooperation also guides the tilting of the swash plate 22 and the movement of the swash plate 22 along the axis of the drive shaft 16. As the swash plate 22 slides backward toward the cylinder block 11, the inclination of the swash plate 22 decreases.

A coil spring 26 is located between the rotor 21 and the swash plate 22. The spring 26 urges the swash plate 22 backward, or in a direction to decrease the inclination of the swash plate 22. The rotor 21 is provided with a projection 21*a* on its rear end face. The abutment of the swash plate 22 against the projection 21*a* prevents the inclination of the swash plate 22 beyond the predetermined maximum inclination.

Figure 4:
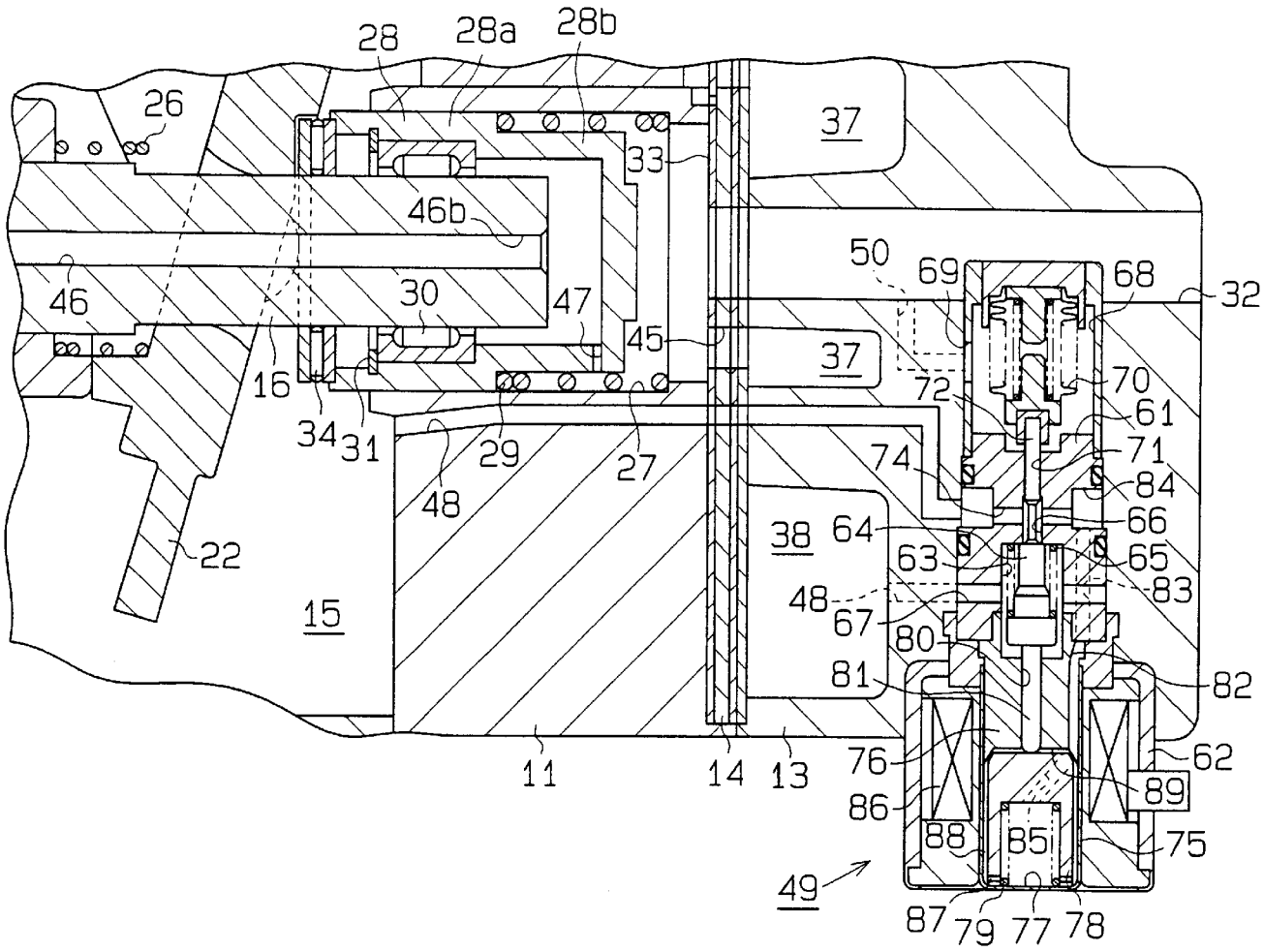
FIG. 4 is an enlarged partial cross-sectional view illustrating a compressor when the inclination of the swash plate is maximum.
Figure 5:
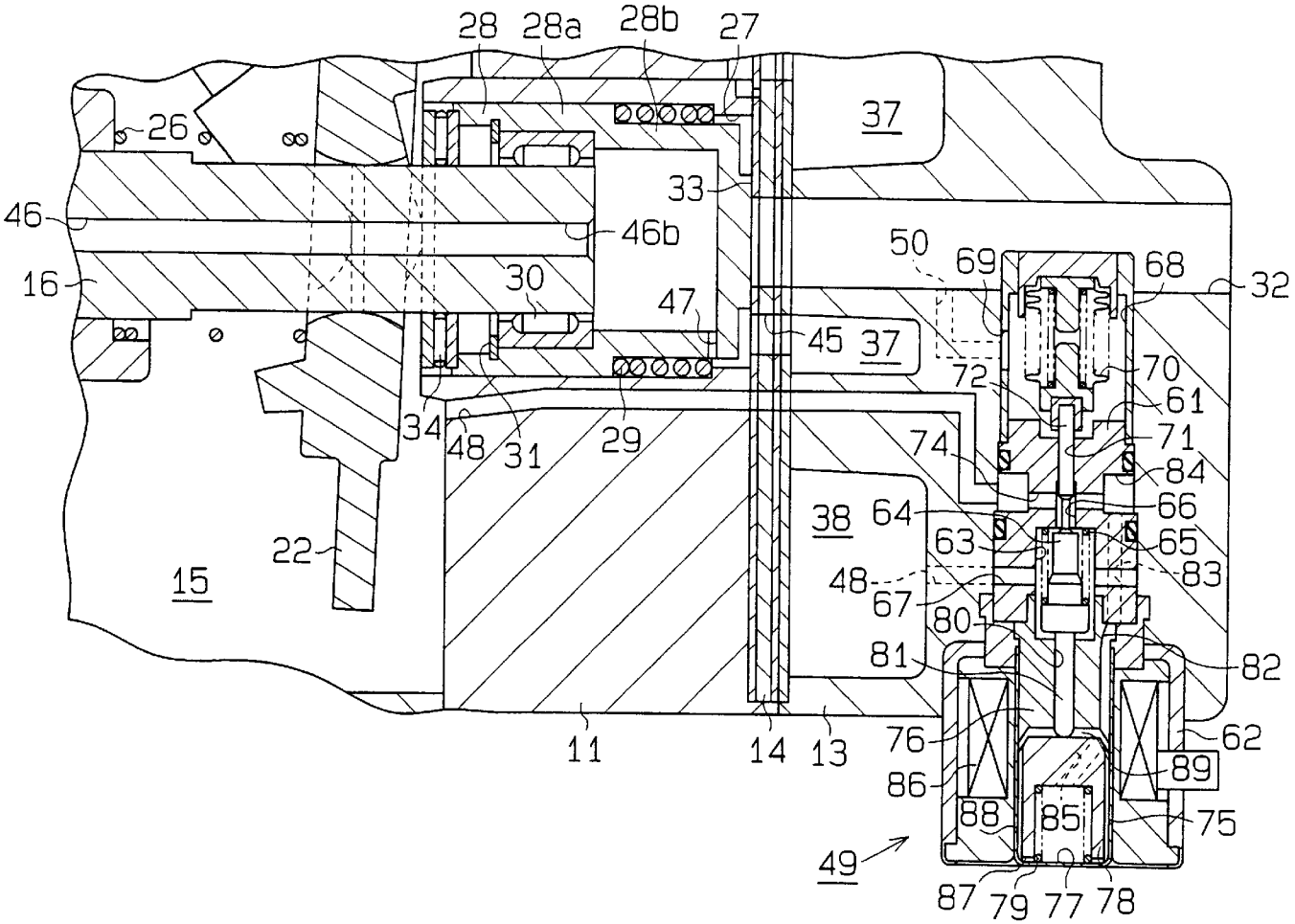
FIG. 5 is an enlarged partial cross-sectional view illustrating a compressor when the inclination of the swash plate is minimum.

As shown in FIGS. 3 to 5, a shutter chamber 27 is defined at the center portion of the cylinder block 11 extending along the axis of the drive shaft 16. A hollow cylindrical shutter 28 having a closed end is accommodated in the shutter chamber 27. The shutter 28 slides along the axis of the drive shaft 16. The shutter 28 has a large diameter portion 28*a* and a small diameter portion 28*b*. A coil spring 29 is located between a step, which is defined between the large diameter portion 28*a* and the small diameter portion 28*b*, and a wall of the shutter chamber 27. The coil spring 29 urges the shutter 28 toward the swash plate 22.

The rear end of the drive shaft 16 is inserted in the shutter 28. The radial bearing 30 is fixed to the inner wall of the large diameter portion 28*a* of the shutter 30 by a snap ring 31. Therefore, the radial bearing 31 moves with the shutter 28 along the axis of the drive shaft 16. The rear end of the drive shaft 16 is supported by the inner wall of the shutter chamber 27 with the radial bearing 30 and the shutter 28 in between.

A suction passage 32 is defined at the center portion of the rear housing 13 and the valve plate 14. The passage 32 extends along the axis of the drive shaft 16 and is communicated with the shutter chamber 27. A positioning surface 33 is formed on the valve plate 14 about the inner opening of the suction passage 32. The rear end of the shutter 28 abuts against the positioning surface 33. Abutment of the shutter 28 against the positioning surface 33 prevents the shutter 28 from further moving backward away from the rotor 21. The abutment also disconnects the suction passage 32 from the shutter chamber 27.

A thrust bearing 34 is supported on the drive shaft 16 and is located between the swash plate 22 and the shutter 28. The thrust bearing 34 slides along the axis of the drive shaft 16. The force of the coil spring 29 constantly retains the thrust bearing 34 between the swash plate 22 and the shutter 28. The thrust bearing 34 prevents the rotation of the swash plate 22 from being transmitted to the shutter 28.

The swash plate 22 moves backward as its inclination decreases. As it moves backward, the swash plate 22 pushes the shutter 28 backward through the thrust bearing 34. Accordingly, the shutter 28 moves toward the positioning surface 33 against the force of the coil spring 29. As shown in FIG. 5, when the swash plate 22 reaches the minimum inclination, the rear end of the shutter 28 abuts against the positioning surface 33. In this state, the shutter 28 is located at the closed position for disconnecting the shutter chamber 27 from the suction passage 32.

As shown in FIG. 3, cylinder bores 11*a* extend through the cylinder block 11 and are located about the axis of the drive shaft 16. A single-headed piston 35 is accommodated in each cylinder bore 11*a*. Each piston 35 is operably coupled to the swash plate 22 by a pair of shoes 36. The swash plate 22 is rotated by the drive shaft 16 through the rotor 21. The rotating movement of the swash plate 22 is transmitted to each piston 35 through the shoes 36 and is converted to linear reciprocating movement of each piston 35 in the associated cylinder bore 11*a*.

An annular suction chamber 37 is defined in the rear housing 13. The suction chamber 37 is communicated with the shutter chamber 27 via a communication hole 45. An annular discharge chamber 38 is defined around the suction chamber 37 in the rear housing 13. Suction ports 39 and discharge ports 40 are formed in the valve plate 14. Each suction port 39 and each discharge port 40 correspond to one of the cylinder bores 11*a*. Suction valve flaps 41 are formed on the valve plate 14. Each suction valve flap 41 corresponds to one of the suction ports 39. Discharge valve flaps 42 are formed on the valve plate 14. Each discharge valve flap 42 corresponds to one of the discharge ports 40.

As each piston 35 moves from the top dead center to the bottom dead center in the associated cylinder bore 11*a,* refrigerant gas in the suction chamber 37 enters each piston bore 11*a* through the associated suction port 39 while causing the associated suction valve flap 41 to flex to an open position. As each piston 35 moves from the bottom dead center to the top dead center in the associated cylinder bore 11*a,* refrigerant gas is compressed in the cylinder bore 11*a* and discharged to the discharge chamber 38 through the associated discharge port 40 while causing the associated discharge valve flap 42 to flex to an open position. Retainers 43 are formed on the valve plate 14. Each retainer 43 corresponds to one of the discharge valve flaps 42. The opening amount of each discharge valve flap 42 is defined by contact between the valve flap 42 and the associated retainer 43.

A thrust bearing 44 is located between the front housing 12 and the rotor 21. The thrust bearing 44 carries the reactive force of gas compression acting on the rotor 21 through the pistons 35 and the swash plate 22.

As shown in FIGS. 3–5, a pressure release passage 46 is defined at the center portion of the drive shaft 16. The pressure release passage 46 has an inlet 46*a*, which opens to the crank chamber 15 in the vicinity of the lip seal 20, and an outlet 46*b*, which opens to the interior of the shutter 28. A pressure release hole 47 is formed in the peripheral wall near the rear end of the shutter 28. The hole 47 communicates the interior of the shutter 28 with the shutter chamber 27.

A gas passage 48 is defined in the rear housing 13, the valve plate 14 and the cylinder block 11. The gas passage 48 communicates the discharge chamber 38 with the crank chamber 15. A displacement control valve 49 is accommodated in the rear housing 13 to regulate the flow of refrigerant gas in the gas passage 48. A pressure introduction passage 50 is defined in the rear housing 13. The pressure introduction passage 50 communicates the control valve 49 with the suction passage 32, thereby applying the suction pressure Ps to the control valve 49.

An outlet port 51 is defined in the cylinder block 11 and is communicated with the discharge chamber 38. The outlet port 51 is connected to the suction passage 32 by an external refrigerant circuit 52. The external refrigerant circuit 52 includes a condenser 53, an expansion valve 54 and an evaporator 55. A temperature sensor 56 is located in the vicinity of the evaporator 55. The temperature sensor 56 detects the temperature of the evaporator 55 and issues signals relating to the detected temperature to a control computer 57. The computer 57 is connected to various devices including a temperature adjuster 58, a compartment temperature sensor 58*a*, and an air conditioner starting switch 59. A passenger sets a desirable compartment temperature, or a target temperature, by the temperature adjuster 58.

The computer 57 inputs signals relating to a target temperature from the temperature adjuster 58, a detected evaporator temperature from the temperature sensor 56, a detected compartment temperature from the temperature sensor 58*a*, and an ON/OFF state of the switch 59. Based on the inputted signals, the computer 57 commands a driving circuit 60 to send an electric current having a certain magnitude to a coil 86 of a solenoid 62 in the control valve 49. The valve 49 will be described later. In addition to the above listed data, the computer 57 may use other data such as the temperature outside the compartment and the speed of the engine E for determining the magnitude of electric current sent to the control valve 49.

The structure of the control valve 49 will now be described.

Figure 1:
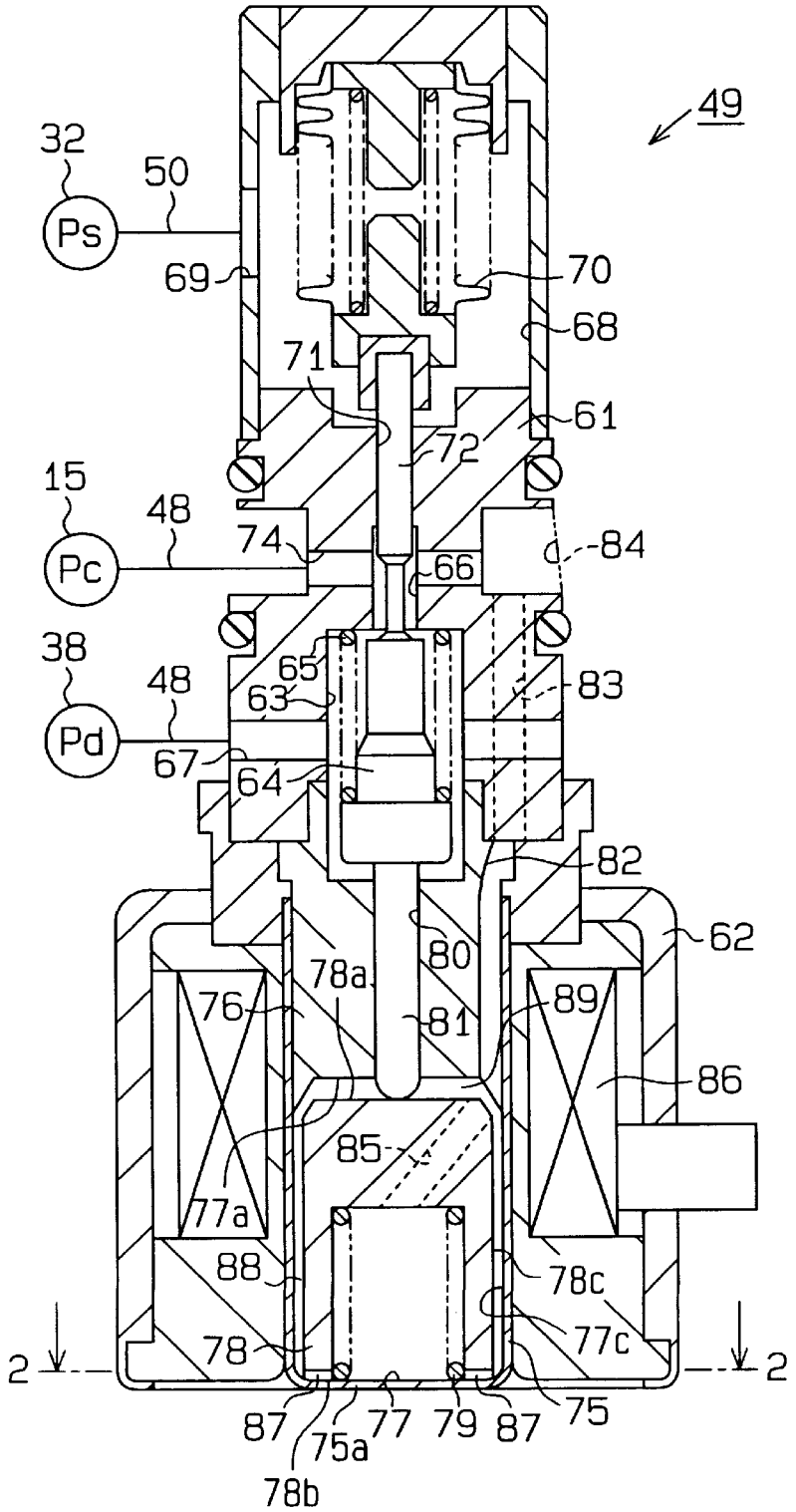
FIG. 1 is a cross-sectional view illustrating a displacement control valve according to a first embodiment of the present invention.
Figure 2:
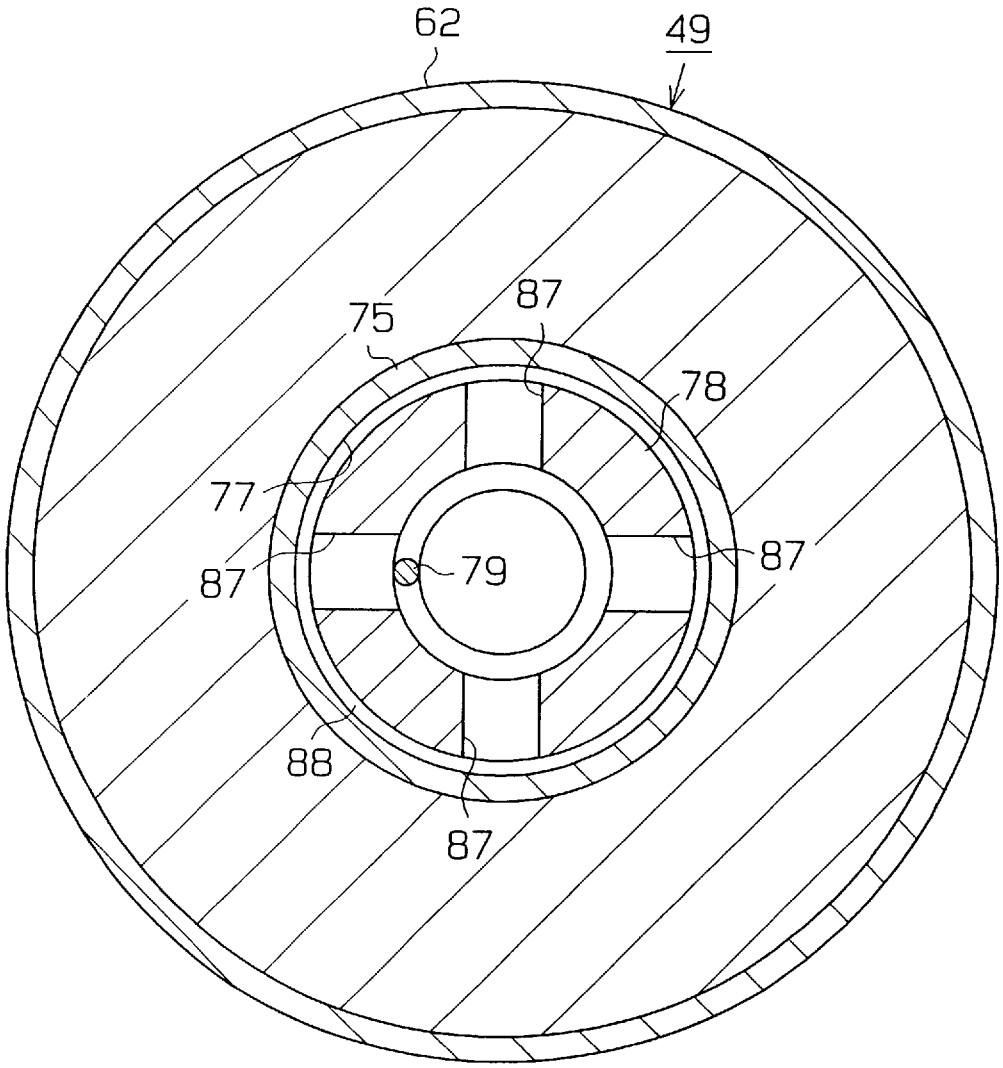
FIG. 2 is a cross-sectional view taken along line 2—2 of FIG. 1.

As shown in FIGS. 1–3, the control valve 49 includes a housing 61 and the solenoid 62, which are secured to each other. A valve chamber 63 is defined between the housing 61 and the solenoid 62. The valve chamber 63 is connected to the discharge chamber 38 by a first port 67 and the gas passage 48. A valve body 64 is arranged in the valve chamber 63. A valve hole 66 is defined to extend axially in the housing 61 and opens in the valve chamber 63. The opening of the valve hole 66 also faces the valve body 64. A first coil spring 65, or biasing member, extends between the valve body 64 and a wall of the valve chamber 63 for urging the valve body 64 in a direction to open the valve hole 66.

A pressure sensing chamber 68 is defined at the upper portion of the housing 61. The pressure sensing chamber 68 is provided with a bellows 70 and is connected to the suction passage 32 by a second port 69 and the pressure introduction passage 50. The suction pressure Ps in the suction passage 32 is thus applied to the chamber 68 via the passage 50. The bellows 70 functions as a reacting member that is responsive to variations of the suction pressure Ps. A first guide hole 71 is defined in the housing 61 between the pressure sensing chamber 68 and the valve hole 66. The axis of the first guide hole 71 is aligned with the axis of the valve hole 66. A first rod 72 extends through the first guide hole 71 for coupling the bellows 70 with the valve body 64. The first rod 72 slides with respect to the first guide hole 71. The first rod 72 has a small diameter portions which extends within the valve hole 66. The clearance between the small diameter portion of the rod 72 and the valve hole 66 permits the flow of refrigerant gas.

A third port 74 is defined in the housing 61 between the valve chamber 63 and the pressure sensing chamber 68. The port 74 extends perpendicularly with respect to the valve hole 66. The valve hole 66 is connected to the crank chamber 15 by the third port 74 and the gas passage 48.

The solenoid 62 has an accommodating cylinder 75 having an open upper end. A fixed steel core 76 is press fitted in the upper opening of the cylinder 75. A plunger chamber 77 is defined by the fixed core 76 and the cylinder 75. The plunger chamber 77 has a first end wall 77*a*, a second end wall 75*a*, which is opposed to the first end wall 77*a*, and a side wall 77*c*. A cylindrical steel plunger 78 having a closed end is accommodated in the plunger chamber 77. The plunger 78 has a first end face 78*a*, a second end face 78*b* which is opposite to the first end face 78*a* and it toward the bottom in FIG. 1, and an outer peripheral surface 78*c*. The plunger 78 slides with respect to the chamber 77. A second coil spring 79 extends between the plunger 78 and the bottom, or second wall 75*a*. of the plunger chamber 77. The urging force of the second coil spring 79 is smaller than that of the first coil spring 65.

A second guide hole 80 is formed in the fixed core 76 between the plunger chamber 77 and the valve chamber 63. A second rod 81 is formed integrally with the valve body 64 and projects downward from the bottom of the valve body 64. The second rod 81 is accommodated in and slides with respect to the second guide hole 80. The cross-sectional area of the second rod 81 is substantially equal to the cross-sectional area of the valve hole 66. The first spring 65 urges the valve body 64 downward, while the second spring 79 urges the plunger 78 upward. This allows the lower end of the second rod 81 to constantly contact the plunger 78. In other words, the valve body 64 moves integrally with the plunger 78 with the second rod 81 therebetween.

A small chamber 84 is defined by the inner wall of the rear housing 13 and the valve housing 61 at a position corresponding to the third port 74. The small chamber 84 is connected to the valve hole 66 by the third port 74. A communication groove 82 is formed in a side of the fixed core 76 and opens in the plunger chamber 77. A communication hole 83 is formed in the middle portion of the housing 61 for communicating the groove 82 with the small chamber 84. The plunger chamber 77 is connected to the valve hole 66 by the groove 82, the communication hole 83, the small chamber 84, and the third port 74. Thus, the pressure in the plunger chamber 77 is equalized with the pressure in the valve hole 66 (crank chamber pressure Pc). The communication groove 82 and the communication hole 83 form a communication passage that connects the plunger chamber 77 to the gas passage 48 downstream of the valve hole 66. The plunger 78 is provided with a through hole 85 that communicates the upper portion of the plunger chamber 77 with the lower portion of the chamber 77.

A cylindrical coil 86 is wound around the fixed core 76 and the plunger 78. The driving circuit 60 provides the coil 86 with electric current based on commands from the computer 57. The computer 57 determines the magnitude of the current provided to the coil 86.

As shown in FIGS. 1 and 2, grooves 87 are radially formed in the bottom, or a second end face 78*b*, of the plunger 78. The grooves 87 and the bottom, or second end wall 75*a* of the plunger chamber 77 define recessed passages through which refrigerant gas flows.

When the plunger 78 is attracted by the fixed core 76 and is closest to the core 76, a gap 89 exists between the upper end, or first end face 78*a*. of the plunger 78 and the lower end of the fixed, or first end wall 77*a* as illustrated in FIG. 1. In other words, the plunger 78 never contacts the fixed core 76. Therefore, even if lubricant oil is spread on the upper end of the plunger 78 and on the lower end of the fixed core 76, the oil does not adhere the plunger 78 to the fixed core 76.

The diameter of the plunger 78 is smaller than the inner diameter of the cylinder 75. Thus, an annular clearance 88 is defined between the plunger 78 and the cylinder 75. The clearance 88 is communicated with the grooves 87 formed in the bottom of the plunger 78.

The operation of the above described compressor will now be described.

When the air conditioner starting switch 59 is on, if the temperature detected by the compartment temperature sensor 58*a* is higher than a target temperature set by the temperature adjuster 58, the computer 57 commands the driving circuit 60 to excite the solenoid 62. Accordingly, electric current having a certain magnitude is sent to the coil 86 from the driving circuit 60. This produces a magnetic attractive force between the fixed core 76 and the plunger 78, as illustrated in FIGS. 3 and 4, in accordance with the current magnitude. The attractive force is transmitted to the valve body 64 by the second rod 81 and thus urges the valve body 64 against the force of the first spring 65 in a direction closing the valve hole 66. On the other hand, the length of the bellows 70 varies in accordance with the suction pressure Ps in the suction passage 32 that is introduced to the pressure sensing chamber 68 via the pressure introduction passage 50. The changes in the length of the bellows 70 are transmitted to the valve body 64 by the first rod 72. The higher the suction pressure Ps is, the shorter the bellows 70 becomes. As the bellows 70 becomes shorter, the bellows 70 moves the valve body 64 in a direction closing the valve hole 66.

The opening area between the valve body 64 and the valve hole 66 is determined by the equilibrium of a plurality of forces acting on the valve body 64. Specifically, the opening area is determined by the equilibrium position of the body 64, which is affected by the force of the solenoid 62, the force of the bellows 70, the force of the first spring 65 and the force of the second spring 79.

Suppose the cooling load is great, the suction pressure Ps is high and the temperature in the vehicle compartment detected by the sensor 58*a* is higher than a target temperature set by the temperature adjuster 58. The computer 57 commands the driving circuit 60 to increase the magnitude of the current sent to the coil 86 as the difference between the compartment temperature and the target temperature increases. This increases the attractive force between the fixed core 76 and the plunger 78, thereby increasing the resultant force that causes the valve body 64 to close the valve hole 66. This lowers the pressure Ps required for moving the valve body 64 in a direction closing the valve hole 66. In this state, the valve body 64 changes the opening of the valve hole 66 in accordance with relatively low suction pressure Ps. In other words, as the magnitude of the current to the control valve 49 is increased, the valve 49 functions to maintain the pressure Ps (the target suction pressure) at a lower level.

A smaller opening area between the valve body 64 and the valve hole 66 decreases the amount of refrigerant gas flow from the discharge chamber 38 to the crank chamber 15 via the gas passage 48. The refrigerant gas in the crank chamber 15 flows into the suction chamber 37 via the pressure release passage 46 and the pressure release hole 47. This lowers the pressure Pc in the crank chamber 15. Further, when the cooling load is great, the suction pressure Ps is high. Accordingly, the pressure in each cylinder bore 11*a* is high. Therefore, the difference between the pressure Pc in the crank chamber 15 and the pressure in each cylinder bore 11*a* is small. This increases the inclination of the swash plate 22, thereby causing the compressor to operate at a large displacement.

When the valve hole 66 in the control valve 49 is completely closed by the valve body 64, the gas passage 48 is closed. This stops the supply of the highly pressurized refrigerant gas in the discharge chamber 38 to the crank chamber 15. Therefore, the pressure Pc in the crank chamber 15 becomes substantially equal to the low pressure Ps in the suction chamber 37. The inclination of the swash plate 22 thus becomes maximum as shown in FIGS. 3 and 4, and the compressor operates at the maximum displacement. The abutment of the swash plate 22 against the projection 21*a* of the rotor 21 prevents the swash plate 22 from inclining beyond the predetermined maximum inclination.

Suppose the cooling load is small, the suction pressure Ps is low and the difference between the compartment temperature detected by the sensor 58*a* and a target temperature set by the temperature adjuster 58 is small. The computer 57 commands the driving circuit 60 to decrease the magnitude of the current sent to the coil 86 as the difference between the compartment temperature and the target temperature becomes smaller. This decreases the attractive force between the fixed core 76 and the plunger 78, thereby decreasing the resultant force that moves the valve body 64 in a direction closing the valve hole 66. This raises the pressure Ps required for moving the valve body 64 in a direction closing the valve hole 66. In this state, the valve body 64 changes the opening of the valve hole 66 in accordance with relatively high suction pressure Ps. In other words, as the magnitude of the current to the control valve 49 is decreased, the valve 49 functions to maintain the pressure Ps (target suction pressure) at a higher level.

A larger opening area between the valve body 64 and the valve hole 66 increases the amount of refrigerant gas flow from the discharge chamber 38 to the crank chamber 15. This increases the pressure Pc in the crank chamber 15. Further, when the cooling load is small, the suction pressure Ps is low and the pressure in the cylinder bores 11*a* is low. Therefore, the difference between the pressure Pc in the crank chamber 15 and the pressure in the cylinder bores 11*a* is great. This decreases the inclination of the swash plate 22. The compressor thus operates at a small displacement.

As the cooling load approaches zero, the temperature of the evaporator 55 in the external refrigerant circuit 52 drops to a frost forming temperature. When the temperature sensor 56 detects a temperature that is equal to or lower than the frost forming temperature, the computer 57 commands the driving circuit 60 to de-excite the solenoid 62. The driving circuit 60 stops sending current to the coil 86, accordingly. This stops the magnetic attractive force between the fixed core 76 and the plunger 78. The valve body 64 is then moved by the force of the first spring 65 against the weaker force of the second spring 81 transmitted by the plunger 78 and the second rod 81. In other words, the valve body 64 is moved in a direction opening the valve hole 66. This causes the plunger 78 to contact the second end wall 75*a* of the plunger chamber 77 and maximizes the opening area between the valve body 64 and the valve hole 66. Accordingly, gas flow from the discharge chamber 38 to the crank chamber 15 is increased. This further raises the pressure Pc in the crank chamber 15, thereby minimizing the inclination of the swash plate 22. The compressor thus operates at the minimum displacement.

When the switch 59 is turned off, the computer 57 commands the driving circuit 60 to de-excite the solenoid 62. Accordingly, the inclination of the swash plate 22 is minimized.

As described above, when the magnitude of the current to the coil 86 is increased, the valve body 64 functions such that the opening area of the valve hole 66 is closed by a lower suction pressure Ps. When the magnitude of the current to the coil 86 is decreased, on the other hand, the valve body 64 functions such that the opening area of the valve hole 66 is closed by a higher suction pressure Ps. The compressor changes the inclination of the swash plate 22 to adjust its displacement thereby maintaining the suction pressure Ps at a target value. Accordingly, the functions of the control valve 49 include changing the target value of the suction pressure Ps in accordance with the magnitude of the supplied current and allowing the compressor to operate at the minimum displacement at any given suction pressure Ps. A compressor equipped with the control valve 49 having such functions varies the cooling ability of the air conditioner.

When the inclination of the swash plate 22 is minimum as illustrated in FIG. 5, the shutter 28 abuts against the positioning surface 33. This prevents the inclination of the swash plate 22 from being smaller than the predetermined minimum inclination. The abutment also disconnects the suction passage 32 from the suction chamber 37. This stops gas flow from the external refrigerant circuit 52 to the suction chamber 37, thereby stopping the circulation of refrigerant gas between the circuit 52 and the compressor.

The minimum inclination of the swash plate 22 is slightly larger than zero degrees. Zero degrees refers to the angle of the swash plate's inclination when it is perpendicular to the axis of the drive shaft 16. Therefore, even if the inclination of the swash plate 22 is minimum, refrigerant gas in the cylinder bores 11*a* is discharged to the discharge chamber 38 and the compressor operates at the minimum displacement. The refrigerant gas discharged to the discharge chamber 38 from the cylinder bores 11*a* enters the crank chamber 15 through the gas passage 48. The refrigerant gas in the crank chamber 15 is drawn back into the cylinder bores 11*a* through the pressure release passage 46, the pressure release hole 47 and the suction chamber 37. That is, when the inclination of the swash plate 22 is minimum, refrigerant gas circulates within the compressor traveling through the discharge chamber 38, the gas passage 48, the crank chamber 15, the pressure release passage 46, the pressure release hole 47, the suction chamber 37 and the cylinder bores 11*a*. This circulation of refrigerant gas allows the lubricant oil contained in the gas to lubricate the moving parts of the compressor.

If the switch 59 is on and the inclination of the swash plate 22 is minimum, an increase in the compartment temperature increases the cooling load. In this case, the temperature detected by the compartment temperature sensor 58*a* is higher than a target temperature set by the compartment temperature adjuster 58. The computer 57 commands the driving circuit 60 to excite the solenoid 62 based on the detected temperature increase. When the solenoid 62 is excited, the gas passage 48 is closed. This stops the flow of refrigerant gas from the discharge chamber 38 into the crank chamber 15. The refrigerant gas in the crank chamber 15 flows into the suction chamber 37 via the pressure release passage 46 and the pressure release hole 47. This gradually lowers the pressure Pc in the crank chamber 15, thereby moving the swash plate 22 from the minimum inclination to the maximum inclination.

As the inclination of the swash plate 22 increases, the force of the spring 29 gradually pushes the shutter 28 away from the positioning surface 33. This gradually enlarges the cross-sectional area of the passage between the suction passage 32 and the suction chamber 37. Accordingly, the amount of refrigerant gas flow from the suction passage 32 into the suction chamber 37 gradually increases. Therefore, the amount of refrigerant gas that enters the cylinder bores 11*a* from the suction chamber 37 gradually increases. The displacement of the compressor gradually increases, accordingly. The discharge pressure Pd of the compressor gradually increases and the torque for operating the compressor also gradually increases. In this manner, the torque of the compressor does not dramatically change in a short time when the displacement changes from the minimum to the maximum. The shock that accompanies load torque fluctuations is thus lessened.

If the engine E is stopped, the compressor is also stopped, that is, the rotation of the swash plate 22 is stopped, and the supply of current to the coil 86 in the control valve 49 is stopped. This de-excites the solenoid 62, thereby opening the gas passage 48. In this state, the inclination of the swash plate 22 is minimum. If the nonoperational state of the compressor continues, the pressures in the chambers of the compressor become equalized and the swash plate 22 is kept at the minimum inclination by the force of spring 26. Therefore, when the engine E is started again, the compressor starts operating with the swash plate 22 at the minimum inclination. This requires the minimum torque. The shock caused by starting the compressor is thus reduced.

Refrigerant gas in the supply passage 48 is drawn into the plunger chamber 77 through the small chamber 84, the communication hole 83 and the communication groove 82.

Therefore, oil contained in the refrigerant gas also enters the plunger chamber 77. The oil is spread on the surface of the plunger 78 and the wall of the plunger chamber 77. Therefore, when the plunger 78 contacts the bottom, or second end wall 75*a,* of the plunger chamber 77 as the coil 86 is de-excited, there is oil between the plunger 78 and the second end wall 75*a*.

In this embodiment, the grooves 87 are formed in the bottom, or second end face 78*b,* of the plunger 78. When the coil is 86 is de-excited and the plunger 78 contacts the second end wall 75*a* of the plunger chamber 77, the grooves 87 and the second end wall 75*a* define passages that allow gas flow. In other words, even if the solenoid 62 is de-excited, the grooves 87 allow part of the plunger's bottom to be separated from the second end wall 75*a* of the plunger chamber 77. Therefore, if oil exists in the plunger chamber 77, the oil does not cause the plunger 78 to adhere to the second end wall 75*a*, and the adhering force of the oil is negligible.

Thus, when the coil 86 is provided with a certain magnitude of current, the plunger 78 is quickly attracted to the fixed core 76 by magnetic attractive force, the magnitude of which corresponds to the magnitude of the coil current. As a result, the valve 64 is smoothly moved by the plunger 87. Further, refrigerant gas in the grooves 87 assists the movement of the plunger 87 toward the fixed core 76. In this manner, the plunger 87 accurately follows changes in the magnitude of current supplied to the coil 86 even if the magnitude of the coil current is small or the changes are subtle. Consequently, the opening amount of the valve hole 66 is accurately controlled by the valve body 64.

The grooves 87 have a simple construction, that is, the grooves 87 only radially extend in the lower surface of the plunger 78. Therefore, forming the grooves 87 is easy.

The clearance 88 is defined between the plunger 78 and the w all of the cylinder 75. Therefore, there is no frictional resistance between the plunger 78 and the cylinder 75. The clearance 88 also allows refrigerant gas to flow into the grooves 87. Thus, the plunger 78 is quickly moved in accordance with changes in current magnitude supplied to the coil 86. Consequently, the valve body 64 is accurately controlled for opening and closing the valve hole 66.

The pressure Pd in the discharge chamber 38 acts on the valve chamber 63, which accommodates the valve body 64, via the gas passage 48 and the first port 67. The valve body 64 is therefore located in refrigerant gas having the relatively high discharge pressure Pd. The cross-sectional area of the second rod 81 is substantially equal to the cross-sectional area of the valve hole 66, which faces the valve body 64. The discharge pressure Pd acts on the valve body 64 except for the part to which the second rod 81 is connected and the part that faces the valve hole 66. Therefore, a force based on discharge pressure Pd that moves the valve body 64 in a direction closing the valve body 66 is equal to a force based on discharge pressure Pd that moves the valve body in a direction opening the valve hole 66. Accordingly, the forces of the discharge pressure Pd acting on the valve body 64 substantially cancel each other out.

The pressure Pc in the crank chamber 15 acts on the valve hole 66 via the gas passage 48 and the third port 74. The pressure Pc in the valve hole 66 is communicated with the plunger chamber 77 via the small chamber 84, the communication passage 83 and the communication groove 82. Accordingly, the pressure in the valve hole 66 is equalized with the pressure in the plunger chamber 77. The valve body 64 is urged by the pressure Pc in the valve hole 66 in a direction opening the valve hole 66. The valve body 64 is also urged by the pressure Pc in the plunger chamber 77, which acts on the distal end of the second rod 81, in a direction closing the valve hole 66. Thus, the pressure Pc acting on the valve body 64 substantially cancels itself off.

As described above, the pressures Pd and Pc acting on the valve body 64 are canceled to the minimum level. Therefore, the valve body 64 does not need to be moved against the discharge pressure Pd or the crank chamber pressure Pc. Thus, the attractive force between the core 76 and the plunger 78 does not need to be increased for moving the valve body 67. In other words, the opening amount of the valve hole 66 is accurately controlled by the valve body 64 without being affected by the pressures Pd and Pc even if the magnitude of the current supplied to the coil 86 is small or the changes in the coil current are subtle.

A second embodiment of the present invention will now be described. The differences from the first embodiment will mainly be discussed below.

Figure 6:
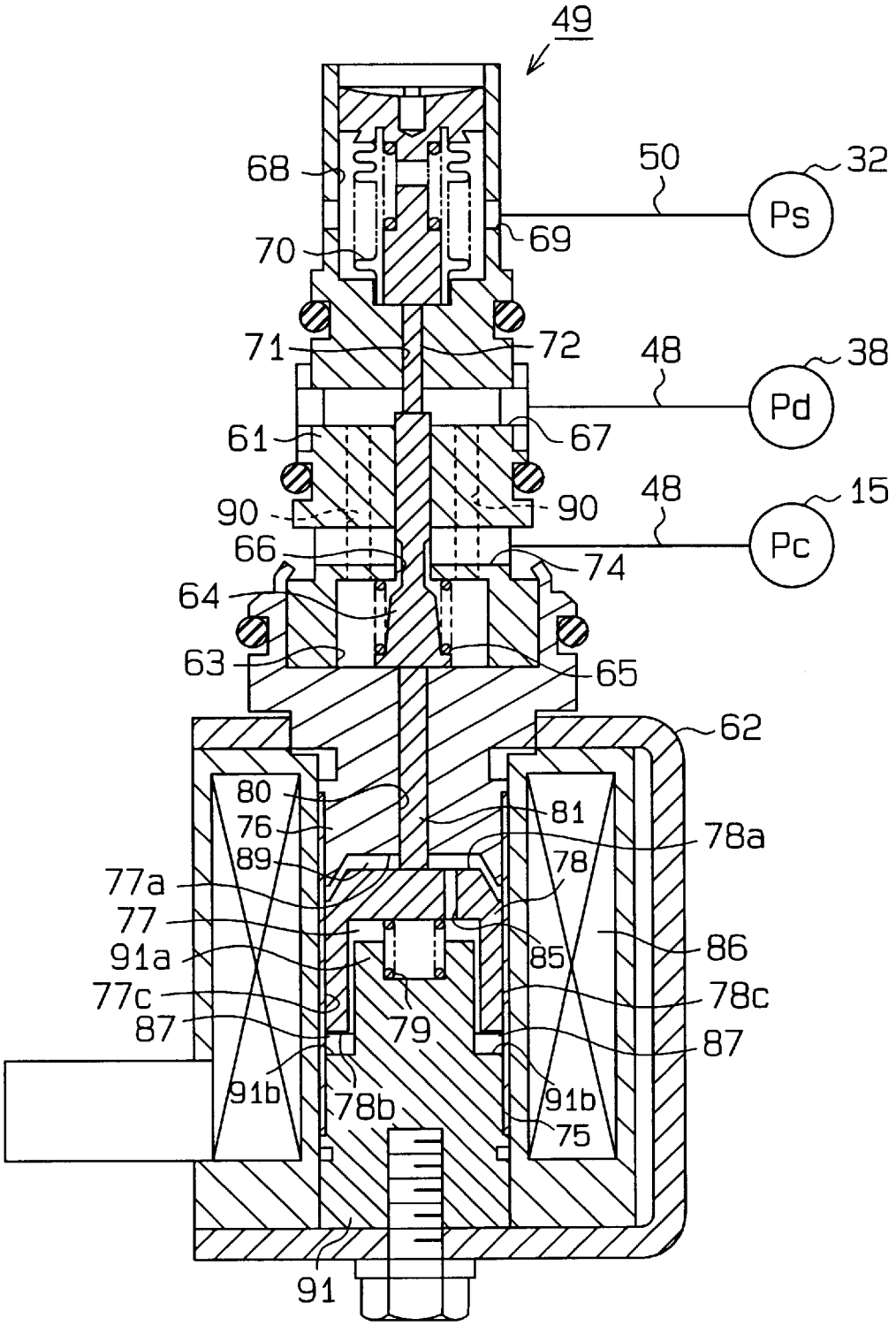
FIG. 6 is a cross-sectional view illustrating a displacement control valve according to a second embodiment of the present invention.
Figure 7:
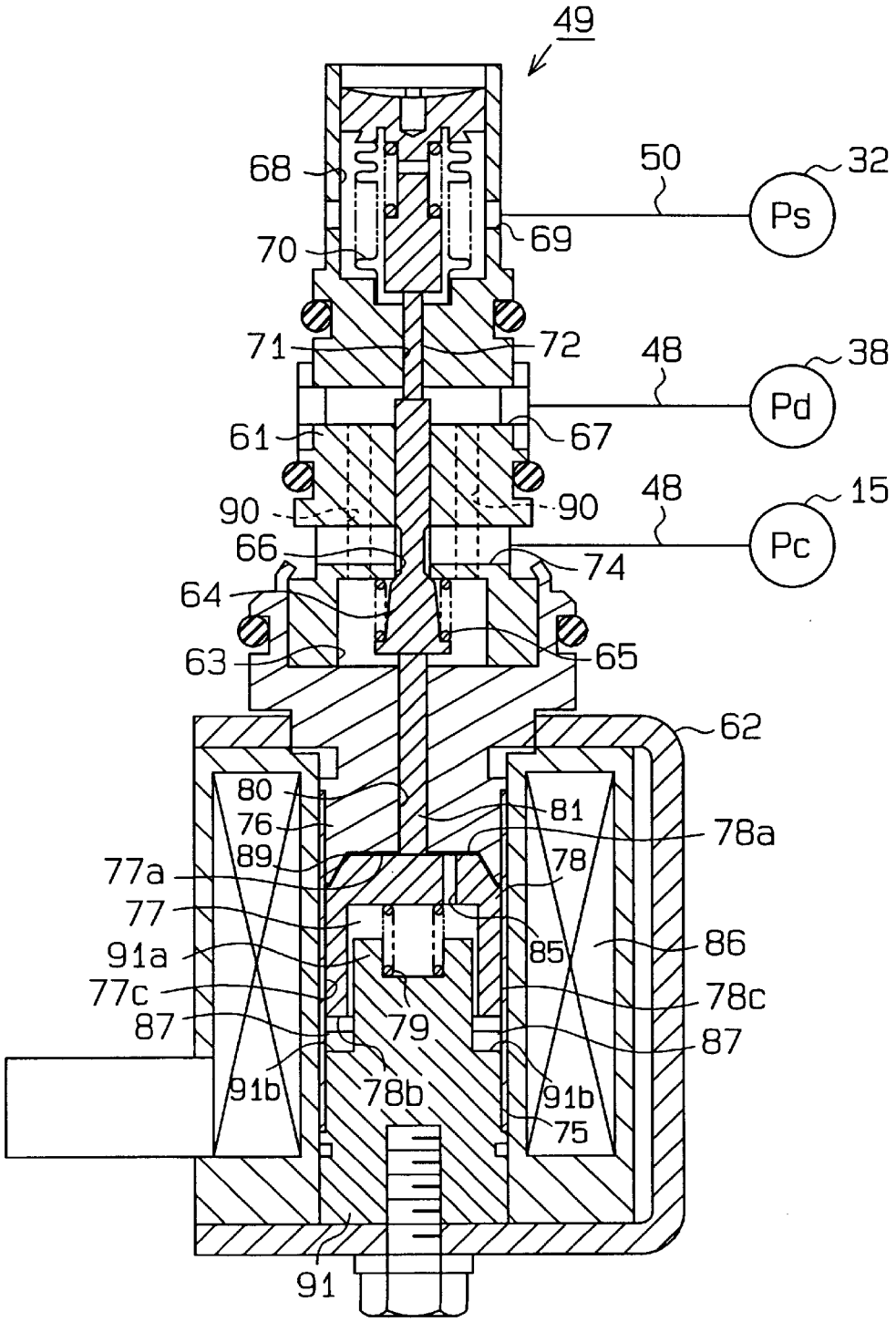
FIG. 7 is a cross-sectional view illustrating the valve of FIG. 6 when the valve is in the closed position.

As shown in FIGS. 6 and 7, a first port 67 is formed in a valve housing 61 near a pressure sensing chamber 68. The first port 67 is connected to a valve chamber 63 by communication holes 90. The first port 67 is communicated with the discharge chamber 38 by the gas passage 48. A third port 74 is formed in the valve housing 61 between the first port 67 and the valve chamber 63. The third port 74 is connected to the valve hole 66 and is communicated with the crank chamber 15 by the gas passage 48.

A cylinder 75 for accommodating a plunger 78 has open ends. A plug 91 is press fitted in the lower end of the cylinder 75. The plug 91 has an upper small diameter portion 91*a*. A plunger 78 is slidably fitted about the small diameter portion 91*a*. Grooves 87 are formed in a step 91*b,* which is defined by the small diameter portion 91*a* and the large diameter portion of the plug 91. The step 91*b* is a second end wall of the plunger chamber 77 in this embodiment. The grooves 87 define recessed passages that allow refrigerant gas to flow between the lower end of the plunger 78 and the step 91*b* of the plug 91.

In the displacement control valve 49 of this embodiment, refrigerant gas in the valve chamber 63 flows into the cylinder 75 through a narrow clearance between the second guide hole 80 and the second rod 81. Oil contained in the refrigerant gas is spread on the plunger 78 and on the step 91*b* of the plug 91. However, grooves 87 formed in the step 91*b* prevent the oil from causing the lower end of the plunger 78 to adhere to the step 91*b*. Therefore, as in the first embodiment, the second embodiment allows the valve body 64 to move quickly and smoothly.

The present invention may be alternatively embodied in the following forms:

In the displacement control valve 49 in the illustrated embodiments, the grooves 87 may be formed in the upper end of the plunger 78 or the lower end of the fixed core 76, which faces the plunger 78. In order to minimize the size of the valve 49, the gap 89 between plunger 78 and the core 76 when the plunger 78 is at a position closest to the core 76 is preferably minimized. In this case, the grooves 87 define passages for allowing refrigerant gas to flow between the upper end of the plunger 78 and the lower end of the fixed core 76. This construction prevents oil from adhering the upper end of the plunger 78 to the lower end of the fixed core 76. Therefore, as in the illustrated embodiments, the plunger 78 follows subtle changes in the magnitude of the current supplied to the coil 86. Accordingly, the opening of the valve hole 66 is accurately controlled by the valve body 64.

In the illustrated embodiments, the pressure sensing chamber 68, the bellows 70, the first guide hole 71 and the first rod 72 constitute a pressure sensing mechanism. This mechanism may be omitted and the opening between the valve body 64 and the valve hole 66 may be controlled by simply changing the magnitude of current supplied to the coil 86 of the solenoid 62. This construction allows the plunger 78 to be moved by a relatively small attractive force. Therefore, the size of the coil 86 and, ultimately, the size of the control valve 49 can be reduced. Further, this construction requires less current to the coil 86. Therefore, the valve 49 consumes less electricity.

In the first embodiment, the annular clearance 88 is defined between the plunger 49 and the cylinder 75. However, the clearance 88 may include grooves formed in the plunger 78 in its axial direction. The grooves constitute the clearance 88 and are communicated with the grooves 87 formed in the bottom of the plunger 78. This construction allows oil to be located between the plunger 78 and the cylinder 75 thereby reducing frictional resistance between the plunger 78 and the cylinder 75. The plunger 78 thus moves smoothly.

The displacement control valve 49 may be incorporated in a variable displacement compressor in which the drive shaft 16 is coupled to the external drive source E with a clutch in between. In this case, it is preferable to disengage the clutch only when the air conditioner starting switch 59 is off and to engage the clutch only when the switch 59 is on. This allows the clutch type compressor to operate in the same manner as the clutchless type compressor illustrated in FIG. 1. Accordingly, the number of times the clutch is engaged is significantly reduced, and the riding comfort of the vehicle is therefore improved.

In the first embodiment, the grooves 87 may be formed in the second end wall 75*a* of the plunger chamber 77.

In the second embodiment, the grooves 87 may be formed in the lower end, or second end face 78*b*, of the plunger 78.

In the first and second embodiments, the third port 74 may be connected to the discharge chamber 38 by the gas passage 48 for introducing the discharge pressure Pd to the valve hole 66. In this case, the first port 67 may be connected to the crank chamber 15 by the gas passage 48 for introducing the crank chamber pressure Pc in the valve chamber 63.

In the compressor illustrated in FIG. 1, the displacement of the compressor is controlled by changing the pressure in the crank chamber 15. However, the displacement may be controlled in different manners. For example, the amount of refrigerant gas supplied to the suction chamber 37 from the external refrigerant circuit 52 may be changed for controlling the pressure in the cylinder bores 11*a* for changing the displacement of the compressor.

Therefore, the present examples and embodiments are to be considered as illustrative and not restrictive and the invention is not to be limited to the details given herein, but may be modified within the scope and equivalence of the appended claims.

What is claimed is:

1. A control valve in a variable displacement compressor that adjusts the discharge displacement in accordance with the inclination of a drive plate located in a crank chamber, wherein the compressor includes a piston operably coupled to the drive plate, the piston being located in a cylinder bore, wherein the piston compresses gas supplied to the cylinder bore from a suction chamber and discharges the compressed gas to a discharge chamber from the cylinder bore, wherein the inclination of the drive plate is variable according to the difference between the pressure in the crank chamber and the pressure in the cylinder bore, wherein the control valve adjusts the difference between the pressure in the crank chamber and the pressure in the cylinder bore, wherein the compressor includes a gas passage for conducting gas, and wherein the control valve regulates the amount of gas flowing in the gas passage, the control valve comprising:

a housing having a valve hole located in the gas passage;

a valve body cooperating with the valve hole, wherein the valve body is movable to adjust the size of the valve hole;

a solenoid for actuating the valve body, wherein the solenoid has a fixed core, a plunger cooperating with the core to move with respect to the core, and a plunger chamber for accommodating the plunger, the plunger having a pair of opposed end walls, wherein electric current sent to the solenoid produces a magnetic attractive force between the core and the plunger in accordance with the value of the current;

a rod located between the plunger and the valve body to actuate the valve body in accordance with the magnetic attractive force;

wherein the plunger has a first end face contacting the rod and a second end face opposite to the first end face, wherein the first and second end faces respectively face corresponding ones of the end walls; and a recessed passage formed in the second end of the plunger through which gas can flow to prevent the second end face from adhering to the corresponding end wall.

2. The control valve according to claim 1, wherein the recessed passage includes a groove provided on at least one of the second end face and the end wall.

3. The control valve according to claim 2, wherein the groove is provided on the second end face.

4. The control valve according to claim 2, wherein the groove extends radially with respect to the axis of the plunger.

5. The control valve according to claim 1, wherein the plunger has an outer peripheral surface, wherein the plunger chamber has a side wall surrounding the outer peripheral surface of the plunger, and wherein a clearance, which communicates with the recessed passage, is defined between the outer peripheral surface of the plunger and side wall of the plunger chamber.

6. The control valve according to claim 1, wherein the core is located between the valve hole and the plunger chamber, and wherein the core has a guide hole for slidably supporting the rod.

7. The control valve according to claim 1 further comprising a communication passage for connecting the plunger chamber with the gas passage.

8. The control valve according to the claim 1, wherein the gas passage connects the discharge chamber with the crank chamber, and wherein the control valve is located in the gas passage for adjusting the amount of gas introduced into the crank chamber from the discharge chamber through the gas passage to control the pressure in the crank chamber.

9. The control valve according to claim 8, wherein the housing has a valve chamber for accommodating the valve body, wherein the valve chamber is connected to the discharge chamber via the gas passage, and wherein the valve chamber is connected to the crank chamber via the valve hole and the gas passage when the valve hole is open.

10. The control valve according to claim 9 further comprising a communication passage for connecting the plunger chamber with a downstream side of the valve hole.

11. The control valve according to claim 1, wherein the plunger biases the valve body toward the valve hole through the rod by the magnetic attractive force.

12. The control valve according to claim 11, wherein a gap is defined between the plunger and the core to prevent the plunger from adhering to the core when the valve body closes the valve hole.

13. The control valve according to claim 11 further comprising a biasing member for biasing the valve body away from the valve hole, wherein, when the solenoid is de-excited, the biasing member biases the valve body and the rod against the plunger such that the plunger abuts against one of the end walls and causes the valve body to maximally open the valve hole.

14. The control valve according to claim 1 further comprising a reacting member that is responsive to pressure variations of the gas supplied to the compressor, wherein the reacting member moves the valve body in accordance with the pressure of the gas supplied to the compressor.

15. A control valve in a variable displacement compressor that adjusts the discharge displacement in accordance with the inclination of a drive plate located in a crank chamber, wherein the compressor includes a piston operably coupled to the drive plate, the piston being located in a cylinder bore, wherein the piston compresses gas supplied to the cylinder bore from a suction chamber and discharges the compresssed gas to a discharge chamber from the cylinder bore, wherein the inclination of the drive plate is a variable according to the difference between the pressure in the crank chamber and the pressure in the cylinder bore, wherein the control valve adjusts the difference between the pressure in the crank chamber and the pressure in the cylinder bore, wherein the compressor includes a gas passage for conducting gas, and wherein the control valve regulates the amount of gas flowing in the gas passage, the control valve comprising:

a housing having a valve opening located in the gas passage;

a valve body cooperating with the valve, wherein the valve body is movable to adjust the size of the valve hole;

a solenoid for actuating the valve body, wherein the solenoid had a fixed core, a plunger cooperating with the core to move with respect to the core, and a plunger chamber for accommodating the plunger, the plunger chamber having a pair of opposed end walls, wherein the core is located between the valve hole and the plunger chamber, wherein the core has a guide hole defined between the valve hole and the plunger chamber, wherein electric current sent to the solenoid produces a magnetic attractive force between the core and the plunger in accordance with the value of the current;

a rod located between the plunger and the valve body to actuate the valve body in accordance with the magnetic attractive force, wherein the rod is slidably supported by the guide hole;

wherein the plunger has a first end face contacting the rod and a second end face opposite to the first end face, wherein the first and second end faces respectively face corresponding ones of the end walls; and a groove formed in the second end of the plunger wherein the groove defines a recessed passage through which gas can flow to prevent the second end face from adhering to the corresponding end wall.

16. The control valve according to claim 15, wherein the groove is provided on the second end face.

17. The control valve according to claim 16, wherein the groove extends radially with respect to the axis of the plunger.

18. The control valve according to claim 15, wherein the plunger has an outer peripheral surface, wherein the plunger chamber has a side wall surrounding the outer peripheral surface of the plunger, and wherein a clearance, which communicates with the recessed passage, is defined between the outer peripheral surface of the plunger and the side wall of the plunger chamber.

19. The control valve according to claim 15, wherein the gas passage connects the discharge chamber with the crank chamber, and wherein the control valve is located in the gas passage for adjusting the amount of gas introduced into the crank chamber from the discharge chamber through the gas passage to control the pressure in the crank chamber.

20. The control valve according to claim 19, wherein the housing has a valve chamber for accommodating the valve body, wherein the valve chamber is connected to the discharge chamber via the gas passage, wherein the valve chamber is connected to the crank chamber via the valve hole and the gas passage when the valve hole is open, and wherein the control valve includes a communication passage for connecting the plunger chamber with a downstream side of the valve hole.

21. The control valve according to claim 15, wherein the plunger biases the valve body toward the valve hole through the rod by the magnetic attractive force, wherein a gap is defined between the plunger and the core to prevent the plunger from adhering to the core when the valve body closes the valve hole.

22. The control valve according to claim 21 further comprising a biasing member for biasing the valve body away from the valve hole, wherein, when the solenoid is de-excited, the biasing member biases the valve body and the rod against the plunger such that the plunger abuts against one of the end walls and causes the valve body to maximally open the valve hole.

* * * * *

UNITED STATES PATENT AND TRADEMARK OFFICE
CERTIFICATE OF CORRECTION

PATENT NO. : 6,062,823

DATED : May 16, 2000

INVENTOR(S) : Masahiro KAWAGUCHI et al.

It is certified that error appears in the above-identified patent and that said Letters Patent is hereby corrected as shown below:

Title page, column 1, after "[73] Assignee:" change "Kabushikki" to --Kabushiki--;

Column 6, line 52, after "second" insert --end--; after "75a" change the period "." to a comma --,--;

Column 7, line 33, after "fixed" insert --core 76--; after "or" and before "first" insert --the--;

Column 10, line 65, after "the" and before "passage" change "supply" to --gas--;

Column 11, line 25, after "plunger" change "87" to --78--;

line 26, after "plunger" change "87" to --78--;

line 27, after "plunger" change "87" to --78--;

line 37, after "the" (first instance) change "w all" to --wall--;

Column 12, line 39, after "end" insert --, or second end face 78b,--

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*